United States Patent [19]

Nishizawa et al.

[11] Patent Number: 4,720,300

[45] Date of Patent: Jan. 19, 1988

[54] PROCESS FOR PRODUCING NIOBIUM METAL OF AN ULTRAHIGH PURITY

[75] Inventors: Keiichiro Nishizawa, Sagamihara; Hajime Sudo, Machida; Masayuki Kudo, Yokohama, all of Japan

[73] Assignee: Toyo Soda Manufacturing Co., Ltd., Shin-nanyo, Japan

[21] Appl. No.: 869,879

[22] Filed: Jun. 3, 1986

[30] Foreign Application Priority Data

Jun. 3, 1985 [JP] Japan ..... 60-118774

[51] Int. Cl.[4] ..... C22B 9/05

[52] U.S. Cl. ..... 75/84.5; 75/84.4

[58] Field of Search ..... 75/84.4, 84.5

[56] References Cited

U.S. PATENT DOCUMENTS

| | | | |
|---|---|---|---|
| 2,766,112 | 10/1956 | Schafer | 75/84.5 |
| 2,934,426 | 4/1960 | Mayer | 75/84.5 X |
| 2,941,867 | 6/1960 | Maurer | 75/84.4 X |
| 3,020,128 | 2/1962 | Adcock et al. | 75/84.5 X |
| 3,230,077 | 1/1966 | Hiller | 75/84.5 |
| 3,269,830 | 8/1966 | Sutherland | 75/84.4 X |
| 3,539,335 | 11/1970 | Svanstrom | 75/84.4 X |
| 3,738,824 | 6/1973 | Davis et al. | 75/84.4 X |

FOREIGN PATENT DOCUMENTS

| | | | |
|---|---|---|---|
| 563413 | 6/1958 | France | 75/84.4 |

*Primary Examiner*—Matthew A. Thexton

*Attorney, Agent, or Firm*—Oblon, Fisher, Spivak, McClelland, & Maier

[57] ABSTRACT

A process for producing niobium metal of an ultrahigh purity, which comprises iodizing niobium metal or niobium chloride containing at least tantalum as an impurity, thermally reducing the iodized product, and then thermally decomposing the reduced product.

8 Claims, 3 Drawing Figures

PROCESS FOR PRODUCING NIOBIUM METAL OF AN ULTRAHIGH PURITY

The present invention relates to a process for producing niobium metal of an ultrahigh purity. More particularly, it relates to a process for producing niobium metal of an ultrahigh purity useful for the production of electronic materials, particularly super conductive thin films.

Heretofore, a purity of 99.9% has been the upper limit for the purity of so-called high purity niobium metal. No process has been known which is capable of efficiently producing niobium metal having an ultrahigh purity of at least 99.99%. For a process for producing niobium metal by the thermal decomposition of a metal iodide, there has been known a closed system method wherein the iodization of niobium metal and the thermal decomposition of the iodized product are conducted in the same closed container to precipitate the metal on a heated wire, or a flow method in which niobium iodide is introduced into a decomposition chamber, whereupon the metal is precipitated on a heated wire. This flow method has an advantage that the iodide can be purified prior to the thermal decomposition. However, both of the above methods have problems such that the decomposition rate of the iodide is very slow (0.01–0.02 $g/cm^2.hr$), and the decomposition temperature is required to be as high as at least 1000° C., whereby it is hardly possible to avoid the reaction of the precipitated metal with the material constituting the container.

Further, it has been reported that in the case of titanium metal, the decomposition rate can be improved by high-frequency heating of the metal in the form of a rod under reduced pressure so that a gaseous iodide is thermally decomposed (Research Report No. 3, 1982, Kinzoku Zairyo Gijutsu Kenkyusho, p 292–302). However, it is difficult to obtain niobium metal of an ultrahigh purity by this method. Further, the decomposition rate is not yet satisfactory, and there still remains a problem that the productivity is poor.

It is an object of the present invention to produce niobium metal of an ultrahigh purity which could not be obtained by the conventional methods. Namely, it is an object of the present invention to provide niobium metal having a purity of at least 99.99% with high production efficiency.

The present invention provides a process for producing niobium metal of an ultrahigh purity, which comprises iodizing niobium metal or niobium chloride containing at least tantalum as an impurity, thermally reducing the iodized product, and then thermally decomposing the reduced product.

Now, the present invention will be described in detail with reference to the preferred embodiments.

In the accompanying drawings.

Figure 1:
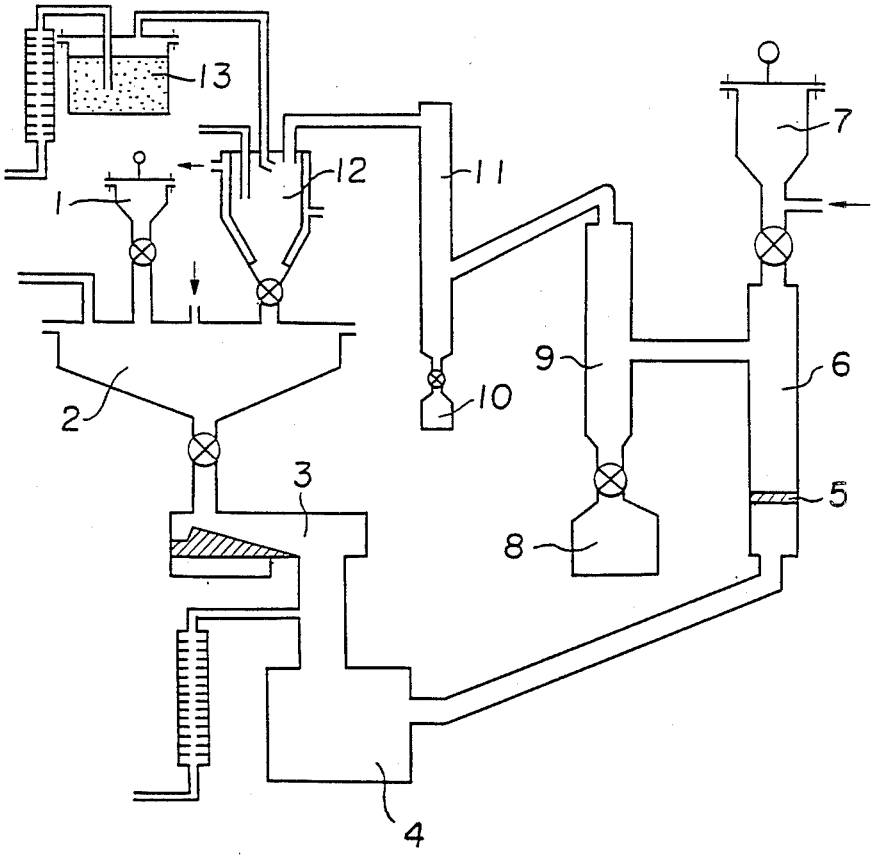
FIG. 1 illustrates an apparatus for continuous iodization useful for the iodization reaction of the present invention.

The process steps of the present invention may be represented by the following reaction formulas.

(1) Iodization step $Nb(Ta)+5/2I_2 \rightarrow Nb(Ta)I_5$ or $Nb(Ta)Cl_5+5HI \rightarrow Nb(Ta)I_5+5HCl$ (2) Thermal reduction step $Nb(Ta)I_5 \rightarrow NbI_3 \downarrow (TaI_5 \uparrow)$ (3) Second iodization step $NbI_3+I_2 \rightarrow NbI_5$ (4) Thermal decomposition step $NbI_5 \rightarrow Nb+5/2I_2$ or $NbI_3 \rightarrow Nb+3/2I_2$ Now, the present invention will be described step by step in further detail.

(1) Iodization step

Niobium metal used as the starting material in the present invention, hereinafter referred to as "crude niobium metal") contains at least tantalum, and it further contains trace amounts of other components such as iron, aluminum, silica, tungsten, zirconium, nickel, chromium, cobalt, thorium and sodium. In addition to the crude niobium metal, niobium chloride may be employed for the iodization.

The iodization reaction may be conducted either in a batch system or in a continuous system. However, the continuous system is preferred from the viewpoint of the productivity and economy.

The iodization proceeds at a high rate at a temperature of 300° C. or higher. Therefore, the reaction temperature is not critical so long as it is at least 300° C. However, it is usual to employ a reaction temperature of from 400° to 600° C. After the completion of the reaction, the iodide is purified by distillation and recovered as a high purity iodide, which is then supplied to the subsequent step of the thermal reduction. In the distillation step, niobium iodide is separated from iodides of the trace amount impurities by the difference in the precipitation temperatures, whereby the trace amount impurities will be reduced to a level of about 1/10.

(2) Thermal reduction step

The thermal reduction treatment of the iodide is conducted in an inert gas atmosphere or in a hydrogen gas atmosphere or under reduced pressure at a temperature of from 200° to 600° C., preferably from 250° to 450° C. Namely, the iodide is introduced into the container and heated under reduced pressure or by using, as a carrier gas, an inert gas such as argon, helium or nitrogen, or a hydrogen gas.

With respect to the separation of niobium from the impurities like tantalum, in the case of an inert gas atmosphere, the higher niobium iodide ($NbI_{4-5}$) starts to undergo a conversion to a lower homologue by the liberation of iodine at a temperature of about 200° C., and starts to form the lower niobium iodide ($NbI_3$) at a temperature of from about 300° to about 350° C., while the higher tantalum iodide ($TaI_{4-5}$) does not undergo a conversion to a lower homologue, whereby due to the substantial difference in the vapour pressures between the lower niobium iodide and the higher tantalum iodide, the impurities like tantalum will be removed from niobium. At a temperature of higher than 600° C., the lower niobium iodide starts to vapourize, and it is not preferable to employ such a high temperature for the reduction according to the present invention.

In the case where the thermal reduction is conducted in a hydrogen gas atmosphere, the lowering phenomenon of the niobium iodide starts to proceed at a temperature of 100° C., and the lower niobium iodide starts to form at a temperature of from about 250° to about 300° C. Namely, the stabilization temperature of the lower niobium iodide is lower by about 50° C. than in the case where the inert gas is used. Whereas, the thermal behavior of the higher tantalum iodide does not substantially change. Therefore, the difference in the vapour pressures between the lower niobium iodide and the higher tantalum iodide increases, whereby the yield of the niobium iodide will be improved. There is no particular restriction as to the temperature raising rate. However, it is usual to employ a rate of about 500° C./min taking into the yield and the purification efficiency into consideration.

In this step, the impurities like tantalum contained in the niobium iodide will be reduced to a level of from 1/10 to 1/100, whereby the lower niobium iodide having a high purity will be recovered.

(3) Second iodization step

This step is not an essential step in the present invention. However, this step is one of the useful steps to obtain niobium metal having a higher purity. This step is conducted substantially in the same manner as the iodization step for niobium metal as described above.

(4) Thermal decomposition step

This step is one of the important steps to obtain niobium metal of an ultrahigh purity in the present invention. Namely, this step is a step wherein the lower niobium iodide ($NbI_3$) or the higher niobium iodide ($NbI_{4.5}$) is thermally decomposed to obtain niobium metal having an ultrahigh purity. The thermal decomposition temperature is usually at least 800° C. However, it should be at least 700° C. There is no particular restriction as to the pressure, but it is usual to employ a pressure of not higher than 10 Torr taking the decomposition efficiency and the purification efficiency into consideration.

There is no particular restriction as to the heat source, which may be high-frequency induction heating or infrared heating. However, it is one of the preferred methods in the present invention that by using a high-frequency induction heating apparatus, a low temperature plasma is generated under vacuum to decompose the iodide and thereby to precipitate niobium metal of an ultrahigh purity. Here, the frequency for the high-frequency induction heating is preferably from a few MHz to a few tens MHz.

Heretofore, a temperature of at least 1000° C. has been required for the thermal decomposition. Whereas, according to the thermal decomposition by means of this high-frequency induction heating apparatus, the decomposition can adequately be conducted at a temperature of about 800° C. by activating the metal iodide by the generation of the low temperature plasma, and the decomposition rate can be improved remarkably i.e. from 10 to 100 times. Further, the purity of niobium metal obtained by this step can be as high as at least 99.99%, and the niobium metal will be useful for electronic materials for which an ultrahigh purity is required, particularly as a starting material for super conductive thin films or alloys.

Figure 2:
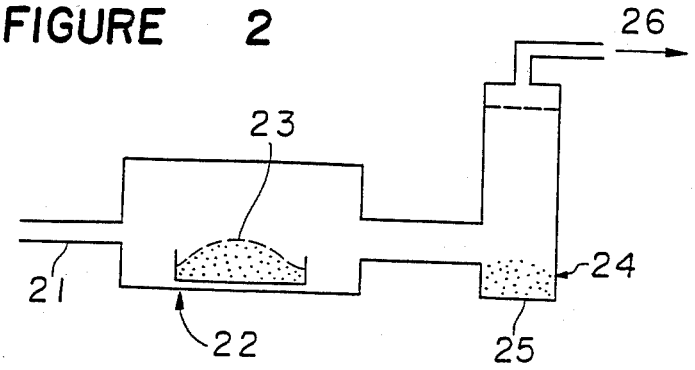
FIG. 2 illustrates an apparatus for the thermal reduction.
Figure 3:
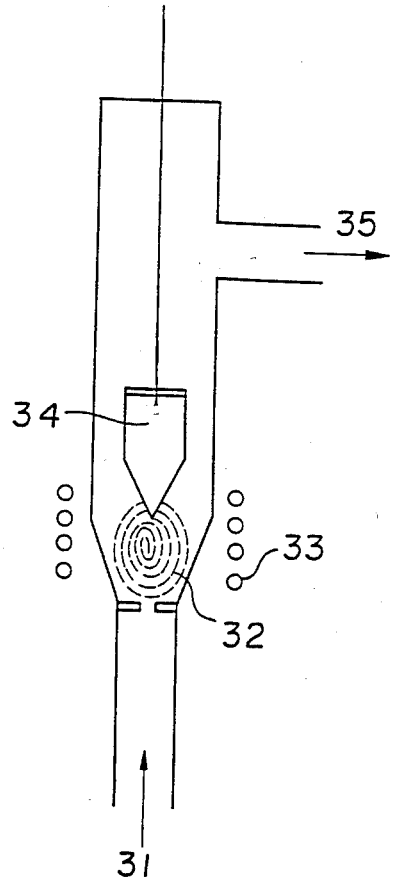
FIG. 3 illustrates an apparatus for the thermal decomposition.

Now, the present invention will be described with reference to the drawings. FIG. 1 illustrates an apparatus for continuous iodization employed for the iodization reaction of the present invention. FIG. 2 illustrates an apparatus for the thermal reduction. Likewise, FIG. 3 illustrates an apparatus for the thermal decomposition.

Referring to FIG. 1, reference numeral 1 indicates a pot for supplemental iodine designed to supplement iodine consumed as the iodides. Reference numeral 2 indicates an iodine reservoir, and numeral 3 indicates a closed iodine feeder (e.g. an electromagnetic feeder), designed to supply iodine in the form of powder quantitatively to an iodine vapourizer 4. The iodine gasified here, is then sent to a reactor 6, and reacted with crude niobium metal supplied from a crude niobium metal pot 7 quantitatively and falling onto a perforated plate 5, whereby niobium iodide is formed. The formed niobium iodide is precipitated in a niobium iodide purification tower 9, and the purified niobium iodide is collected into a niobium iodide collecting pot 8. Unreacted iodine and iodides of impurities are led to an iodine distillation tower. The iodides of impurities are collected into a pot 10, and the purified iodine gas is led to an iodine quenching trap 12 cooled by a cooling medium. Here, the iodine gas is rapidly cooled by an inert gas cooled by a condenser 13, and formed into a powder, which is again fed back to the iodine reservoir 2. Thus, niobium iodide having a high purity is continuously produced, and at the same time, iodine is recycled in a completely closed system.

Referring to the operational method more specifically, the degassing and dehydration are conducted by vacuuming the entire system at a level of not higher than $10^{-2}$ Torr, by heating the system to a temperature of at least about 300° C., and by maintaining the condition for a long period of time. Then, iodine is supplied in a proper amount to the iodine vapourizer heated to a temperature higher than the boiling point of iodine, and the entire system is made under an iodine atmosphere. Further, when the respective portions reach the predetermined temperatures, crude niobium metal is supplied for iodization.

Referring to FIG. 2, reference numeral 21 indicates a carrier gas inlet, numeral 22 indicates a reaction tube for the thermal reduction, and numeral 23 indicates niobium iodide. A proper amount of the carrier gas is introduced from the carrier gas inlet 21 into the reaction tube for the thermal reduction in which niobium iodide 23 is placed, and the thermal reduction is conducted. The vapourized impurities such as the higher tantalum iodide are collected by an impurity collecting trap 24. Thus, the purified lower niobium iodide remains in the reaction tube 22, and is recovered, whereas the iodides of impurities 25 accumulate in the impurity collecting trap 24. Reference numeral 26 in FIG. 2 indicates an exhaust gas line.

In FIG. 3, reference numeral 31 indicates a purified niobium iodide gas inlet, numeral 32 indicates a low temperature plasma, numeral 33 indicates a high frequency induction heating coil, numeral 34 is a seed metal, numeral 35 indicates a gas outlet. From the inlet 31, the purified niobium iodide is introduced in the form of a gas, and decomposed in the vicinity of the seed metal 34 (most preferably niobium metal i.e. the same as the precipitating metal) heated to a high temperature by the high frequency induction heating coil 33, whereupon niobium metal deposits on the seed metal. At the same time, argon gas is supplied form the gas inlet 31 to generate a stabilized low temperature plasma 32 below the seed metal 34, and the purified niobium iodide gas is activated in the plasma. Surprisingly, by such a method, the thermal decomposition of the purified niobium iodide can be conducted at a temperature lower by about 200° C. than the conventional decomposition temperature, and yet the decomposition rate is improved by from 10 to 100 times. For the generation of the low temperature plasma and for the decomposition, a reduced pressure of not higher than 1 to 2 Torr is sufficient when the purified niobium gas iodide and argon gas flow in the system. Unreacted iodine and liberated iodine are removed from the gas outlet 35 and then recovered for reuse.

Now, the present invention will be described in detail with reference to Examples. However, it should be understood that the present invention is by no means restricted by these specific Examples.

1. EXAMPLES FOR IODIZATION STEP

Example 1-1

By using the apparatus as shown in FIG. 1, crude niobium metal was continuously iodized under the following conditions.

| Conditions | (1) | (2) |
|---|---|---|
| Iodine supply rate | 13 g/min | 13 g/min |
| Niobium supply rate | 1 g/min | 1 g/min |
| Iodine vapourizer temperature | 200° C. | 220° C. |
| Iodization temperature | 500° C. | 550° C. |
| Tower top temperature of the iodide purification tower | 250° C. | 180° C. |
| Tower top temperature of the iodine purification tower | 185° C. | 190° C. |
| Tower bottom temperature of the iodine purification tower | 200° C. | 200° C. |
| Niobium iodide forming rate | 6.4 g/min | 7.5 g/min |

The purification effects by the production of niobium iodide under the above conditions are shown in Table 1.

TABLE 1

| | (1) | | | (2) | | |
|---|---|---|---|---|---|---|
| | Ta | Fe | Al | Ta | Fe | Al |
| Crude niobium metal (ppm) | 2000 | 20 | 30 | 2000 | 20 | 30 |
| Impurities (as calculated as niobium) in the iodide (ppm) | 180 | 2 | 5 | 200 | 3 | 6 |

Metal impurities other than Ta, Fe and Al were less than 1 ppm.

The ratio of bound iodine in the formed niobium iodide is shown in Table 2.

TABLE 2

| | Nb (wt. %) | Bound iodine (wt. %) | Free iodine (wt. %) | I/Nb (molar ratio) |
|---|---|---|---|---|
| (1) | 12.95 | 87.03 | 0.02 | 4.92 |
| (2) | 12.90 | 87.05 | 0.05 | 4.94 |

Example 1-2

Examples for the iodization step where niobium chloride was used as the starting material, will be given.

Example 1-2-1

10 g of niobium pentachloride having a particle diameter of from 10 to 100 μm obtained by the chlorination and purification of commercially available ferroniobium, was supplied (0.15 g/min) to the reaction tube in a counter current relation with HI, and HI containing 2% of $I_2$ was introduced at a rate of 0.7 g/min.

The reaction zone was preliminarily heated to 150° C. The iodide collected at the lower portion of the reaction tube was niobium pentaiodide ($NbI_5$) comprising 12.3% of Nb, 0.4% of free iodine and 87.3% of bound iodine. The yield was 97%.

Example 1-2-2

Niobium pentachloride as used in Example 1-2-1 was heated to 200° C., and supplied (0.15 g/min) to a horizontal type reactor by using argon gas as the carrier gas. HI gas and $I_2$ gas (partial pressure: 100 mmHg) were supplied at a rate of 0.7 g/min. The reaction temperature was kept at 300° C.

Niobium pentaiodide thereby obtained was 25 g. Free iodine was 0.2%. The yield was 95%.

2. EXAMPLES FOR THERMAL REDUCTION STEP

Example 2-1

An apparatus as shown in FIG. 2 was used. 50 g of niobium iodide ($NbI_5$) containing 0.12% by weight of tantalum iodide ($TaI_5$) (obtained by iodizing niobium containing 2000 ppm of tantalum) was employed as the starting material iodide. The thermal reduction was conducted for 2 hours to remove tantalum by using 100 ml/min of argon gas as the carrier gas. The temperature raising rate was 500° C./min. The Ta content (based on Nb) in the remained niobium iodide and the yield of Nb are as shown in Table 3.

TABLE 3

| Thermal reduction temperature (°C.) | Ta content (based on Nb) (ppm) | Yield of Nb (%) |
|---|---|---|
| 250 | 500 | 87 |
| 300 | 50 | 92 |
| 350 | 30 | 83 |
| 400 | 10 | 87 |
| 450 | 9 | 85 |

Example 2-2

The thermal reduction was conducted under the same conditions as in Example 2-1 except that 100 ml/min of hydrogen gas was used as the carrier gas. The results are shown in Table 4.

TABLE 4

| Thermal reduction temperature (°C.) | Ta content (based on Nb) (ppm) | Yield of Nb (%) |
|---|---|---|
| 200 | 800 | 99 |
| 250 | 150 | 98 |
| 300 | 10 | 98 |
| 350 | 5 | 97 |
| 400 | 4 | 96 |

As shown above, the yield was remarkably improved by using hydrogen gas.

Example 2-3

Table 5 shows the results on the Ta content (based on Nb) in the remained niobium iodide and the yield of Nb in the cases where the temperature raising rate was differentiated at levels of 150° C./min, 300° C./min and 500° C./min by using the same starting material iodide as used in Examples 2-1 and 2-2 and 100 ml/min of hydrogen as the carrier gas at a thermal reduction temperature of 300° C. or 400° C. for a thermal reduction time of 2 hours.

TABLE 5

| Thermal reduction temperature (°C.) | Temperature raising rate (°C./min) | Ta content (based on Nb) (ppm) | Yield of Nb (%) |
|---|---|---|---|
| 300 | 150 | 35 | 87 |

TABLE 5-continued

| Thermal reduction temperature (°C.) | Temperature raising rate (°C./min) | Ta content (based on Nb) (ppm) | Yield of Nb (%) |
|---|---|---|---|
| | 300 | 12 | 94 |
| | 500 | 10 | 98 |
| 400 | 150 | 32 | 85 |
| | 300 | 6 | 91 |
| | 500 | 4 | 96 |

Example 2-4

The thermal reduction was conducted by using the same starting material iodide and the same apparatus as used in Examples 2-1 and by vacuuming the apparatus to maintain the interior under reduced pressure. The results are shown in Table 6.

TABLE 6

| Thermal reduction temperature (°C.) | Ta content (based on Nb) (ppm) | Yield of Nb (%) |
|---|---|---|
| 200 | 230 | 98 |
| 300 | 120 | 95 |
| 400 | 92 | 89 |
| 500 | 132 | 72 |

3. EXAMPLES FOR SECOND IODIZATION STEP

Example 3-1

By using the same apparatus as used in the first iodization step, the lower niobium iodide instead of the crude niobium metal, was continuously iodized.

The conditions for the second iodization are shown below, and the quality of the niobium iodide thereby obtained is shown in Table 7.

| Conditions | |
|---|---|
| Iodine supply rate | 13 g/min |
| Lower iodide supply rate | 13 g/min |
| Second iodization temperature | 500° C. |
| Tower top temperature of iodide purification tower | 250° C. |

TABLE 7

| | Ta | Fe | Al |
|---|---|---|---|
| Impurities (as calculated as niobium) in the lower niobium iodide (ppm) | 30 | 4 | 7 |
| Impurities (as calculated as niobium) in the purified iodide (ppm) | 25 | 2 | 2 |

4. EXAMPLES FOR THERMAL DECOMPOSITION

Example 4-1

By using an apparatus as shown in FIG. 3, the niobium iodide purified in the above-mentioned step was thermally decomposed. The conditions for the thermal decomposition are as shown below. The frequency of the high frequency induction heating apparatus was 4 MHz to generate a low temperature plasma. A niobium metal rod having a diameter of 10 mm and a length of 25 mm was used as a seed metal rod.

| Conditions | (1) | (2) |
|---|---|---|
| Thermal decomposition temperature | 800° C. | 1000° C. |
| Niobium iodide supply rate | 60 g/Hr | 60 g/Hr |
| Vacuum degree | $2 \times 10^{-1}$ Torr | $2 \times 10^{-1}$ Torr |
| Argon gas flow rate | 10-20 ml/min | 10-20 ml/min |

The results of the thermal decomposition are shown in Table 8.

TABLE 8

| Analytical values (ppm) | Nb precipitation rate (1) 1.0 g/cm$^3$ · Hr | (2) 4.0 g/cm$^3$ · Hr |
|---|---|---|
| Ta | 7 | 10 |
| Fe | <1 | <1 |
| Al | <1 | <1 |
| O | 10 | 10 |
| H | <1 | <1 |
| C | 25 | 25 |

The total amount of other components was not higher than 1 ppm.

As described in the foregoing, the precipitation rate is remarkably improved over the conventional methods, and Nb having an ultrahigh purity of at least 99.99% was obtained.

Example 4-2

Table 9 shows the decomposition efficiency and the purification effects in the cases where the vacuum degree was differentiated at levels of atmospheric pressure, 30 Torr, 10 Torr, 4 Torr and 0.2 Torr without generating a plasma by using the same apparatus and a high frequency heating apparatus of 400 KHz.

TABLE 9

| | Decomposition efficiency (%) | Ta concentration (ppm) |
|---|---|---|
| Atmospheric pressure | 18 | 24 |
| 30 Torr | 20 | 20 |
| 10 Torr | 38 | 15 |
| 4 Torr | 40 | 12 |
| 0.2 Torr | 53 | 10 |

Example 5

Working Examples will be given which show the entire process of the present invention comprising a series of the above described steps. The conditions of the respective steps are shown in Table 10. The purification states and the analytical values of the final niobium of an ultrahigh purity thereby obtained are shown in Table 11.

TABLE 10

| Steps | Conditions for the respective steps | (1) | (2) |
|---|---|---|---|
| Iodization | Iodine supply rate | 13 g/min | 13 g/min |
| | Niobium supply rate | 1 g/min | 1 g/min |
| | Iodine vapourization temperature | 200° C. | 200° C. |
| | Iodization temperature | 500° C. | 550° C. |
| | Tower top temperature of iodide purification tower | 250° C. | 180° C. |

TABLE 10-continued

| Steps | Conditions for the respective steps | (1) | (2) |
|---|---|---|---|
| Thermal reduction | Thermal reduction temperature | 450° C. | 400° C. |
| | Carrier gas (flow rate) | Ar(500 ml/min) | Ar(500 ml/min) |
| | Temperature raising rate | 500° C./min | 500° C./min |
| | Amount (niobium iodide) treated for thermal reduction | 600 g | 600 g |
| | Thermal reduction time | 4 Hr | 4 Hr |
| Second iodization | Second iodization temperature | 500° C. | 500° C. |
| | Iodine vapourization temperature for second iodization | 200° C. | 200° C. |
| Thermal decomposition | Thermal decomposition temperature | 1000° C. | 1100° C. |
| | Niobium supply rate | 69 g/Hr | 60 g/Hr |
| | Vacuum degree | $2 \times 10^{-1}$ Torr | $2 \times 10^{-1}$ Torr |
| | Argon gas flow rate | 10–20 ml/min | 10–20 ml/min |

TABLE 11

| | | Purification results | | | | | | | | | | |
|---|---|---|---|---|---|---|---|---|---|---|---|---|
| | | Ta | Fe | Al | Si | W | Zr | Cr | Mo | O | H | C |
| Crude niobium metal | | 2000 | 20 | 30 | 20 | 30 | 10 | 10 | 10 | 200 | 10 | 100 |
| After iodization | (1) | 180 | 2 | 5 | 8 | 2 | 5 | <1 | <1 | — | — | — |
| | (2) | 200 | 3 | 6 | 12 | 2 | 8 | <1 | <1 | — | — | — |
| After thermal | (1) | 8 | 3 | 2 | <1 | <1 | <1 | <1 | <1 | — | — | — |
| reduction | (2) | 15 | 4 | 2 | <1 | <1 | <1 | <1 | <1 | — | — | — |
| After thermal | (1) | 6 | <1 | <1 | <1 | <1 | <1 | <1 | <1 | 15 | <1 | 25 |
| decomposition* | (2) | 8 | <1 | <1 | <1 | <1 | <1 | <1 | <1 | 15 | <1 | 25 |

(Analytical values are all based on Nb. (Unit: ppm))
*Analytical values for the final niobium of an ultrahigh purity.

As shown above, it is possible to obtain Nb having an ultrahigh purity of at least 99.99% by purifying crude niobium metal having a poor purity (from 99 to 99.9%) by the process of the present invention.

We claim:

1. A process for producing niobium metal of ultrahigh purity, which comprises:
   (a) iodizing niobium metal or niobium chloride containing at least tantalum as an impurity, in the presence of an iodizing agent at a temperature of at least 300° C., thereby preparing an iodized product containing a higher niobium iodide;
   (b) thermally reducing said iodized product in an inert gas atmosphere at a temperature of from 200°–600° C., or a hydrogen gas atmosphere at a temperature from 100°–300° C., thereby converting at least a portion of said higher niobium iodide to a lower niobium iodide; and
   (c) thermally decomposing the higher and lower niobium iodides at a temperature of at least 700° C., thereby forming said niobium metal.

2. The process according to claim 1, wherein said iodization in step (a) is effected at a temperature of 400°–600° C.

3. The process according to claim 1, wherein the thermmal reduction of the iodized product in an inert gas atmosphere in step (b) is effected at a temperature of from 250°–450° C.

4. The process according to claim 1, wherein the thermal decomposition of step (c) is further conducted at a pressure of not more than 10 Torr.

5. The process according to claim 1, wherein the thermal decomposition is conducted by a low temperature plasma.

6. The process according to claim 1, wherein the thermal decomposition is conducted under atmospheric pressure or under reduced pressure.

7. The process according to claim 1, wherein the niobium metal of an ultrahigh purity has a purity of at least 99.99%.

8. The process according to claim 1, which further comprises iodizing the thermally reduced product between the steps of thermal reduction and thermal decomposition.

* * * * *